US010587075B1

(12) United States Patent
Lin et al.

(10) Patent No.: US 10,587,075 B1
(45) Date of Patent: Mar. 10, 2020

(54) ANTI-THEFT CONNECTOR HEAD STRUCTURE

(71) Applicant: Elka International Ltd, New Taipei (TW)

(72) Inventors: Kai-Hsuan Lin, New Taipei (TW); Yi-Chieh Cheng, New Taipei (TW); You-Yuan Deng, Dongguan (CN)

(73) Assignee: ELKA INTERNATIONAL LTD, New Taipei (TW)

( * ) Notice: Subject to any disclaimer, the term of this patent is extended or adjusted under 35 U.S.C. 154(b) by 0 days.

(21) Appl. No.: 16/425,917

(22) Filed: May 29, 2019

(51) Int. Cl.
*H01R 13/60* (2006.01)
*H01R 31/06* (2006.01)
*E05B 73/00* (2006.01)

(52) U.S. Cl.
CPC ..... *H01R 13/60* (2013.01); *E05B 73/0005* (2013.01); *H01R 31/06* (2013.01)

(58) Field of Classification Search
CPC .. H01R 13/6397; H01R 33/97; E05B 73/0005
USPC ..... 439/133, 304
See application file for complete search history.

(56) References Cited

U.S. PATENT DOCUMENTS

| | | | | |
|---|---|---|---|---|
| 9,273,496 | B2 * | 3/2016 | Theobald | E05B 73/0005 |
| 9,312,624 | B2 * | 4/2016 | Borden | H01R 13/44 |
| 9,644,402 | B1 * | 5/2017 | Su | E05B 73/0082 |
| 10,148,038 | B2 * | 12/2018 | Cunningham | H01R 13/639 |

* cited by examiner

*Primary Examiner* — Hien D Vu
(74) *Attorney, Agent, or Firm* — Chun-Ming Shih

(57) ABSTRACT

An anti-theft connector head structure includes at least a connector head, a latch lock piece, a fastening ring, and a protection sleeve. On a side of a main body of the connector head is disposed a first connector end, on the other side of the main body is disposed a second connector end. The latch lock piece is a flexible wire body, a tail portion of a movable end on one side of the latch lock piece is provided with a buckle, on the other side of the latch lock piece is a fixed end, disposed on the main body of the connector head. In a center of the fastening ring is provided with a connector seat, connected and fixed to a fixed point. In the protection sleeve is provided with a chamber, to receive the fastening ring and the buckle.

9 Claims, 7 Drawing Sheets

ANTI-THEFT CONNECTOR HEAD STRUCTURE

BACKGROUND OF THE INVENTION

Field of the Invention

The present invention relates to a connector head, and in particular to an anti-theft connector head structure.

The Prior Arts

Nowadays, due to the widespread and increasing use of Internet, people usually use 3 C products, such as handsets, notebook computers, to send and receive e-mail and to gather information easily and conveniently. As such, the 3C products play an important role in our daily life. In this respect, the price of new generation of 3C product tends to be high, and since it is of light weight and compact size, it is liable to be stolen and taken away easily in an Exhibition. Therefore, presently on the market, quite a lot of anti-theft locks and chains are available, to prevent 3C products from being stolen.

In addition, a lot of high-end connectors and adapters are available on the market and are often placed in an Exhibition for display and sales promotion. Due to the enormous crowd on sight, the connectors and adapters can be stolen and taken away easily, to cause losses and damages to the vendors. Even worse, this may cause supply shortage of 3C products, to adversely affect the normal operations of an Exhibition.

For the conventional anti-theft connector head, on an adapter is provided with a hole, for a ring-shape rope body to penetrate through. And a fastening sleeve tube is disposed on the rope body, to be fixed onto a fix position of the adapter, to restrict the adapter connected to move only in a range of the length of the ring-shape rope body, to prevent theft from happening. However, this type of structure is rather too simple, the anti-theft function is not sufficient, thus the adapter can easily be broken, to cause damage and loss to its user.

Therefore, presently, the design and performance of the anti-theft connector head is not quite satisfactory, and it leaves much room for improvements.

SUMMARY OF THE INVENTION

In view of the problems and drawbacks of the prior art, the present invention provides an anti-theft connector head, that is novel in design, and easy to operate.

The present invention provides an anti-theft connector head structure, that includes at least a connector head, a latch lock piece, a fastening ring, and a protection sleeve, On a side of a main body of the connector head is disposed a first connector end, on the other side of the main body is disposed a second connector end.

The latch lock piece is a flexible wire body, a tail portion of a movable end on one side of the latch lock piece is provided with a buckle, on the other side of the latch lock piece is a fixed end, disposed on the main body of the connector head.

In a center of the fastening ring is provided with a connector seat, connected and fixed to a fixed point, a plurality of spacer bolt holes are provided on an outer perimeter of the fastening ring, with the buckle of the latch lock piece being movably fastened into the corresponding spacer bolt holes respectively.

In the protection sleeve is provided with a chamber, to receive the fastening ring and the buckle, and on the protection sleeve is disposed a locking mechanism to seal up the fastening ring and the buckle.

Compared with the Prior Art, the anti-theft connector head structure of the present invention has the following advantages: It allows people to gather and protect the latch lock piece connected to the connector head, with the buckle on a tail portion of the latch lock piece being movably fastened into the corresponding spacer bolt holes respectively. Then place the protection sleeve outside the fastening ring, to be sealed effectively by using a locking mechanism. The range of movement of the connector head is restricted by the latch lock piece, while the connector heads around the perimeter of the fastening ring could provide effective protection against theft, to prevent it from being broken easily and stolen away.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

Figure 1:
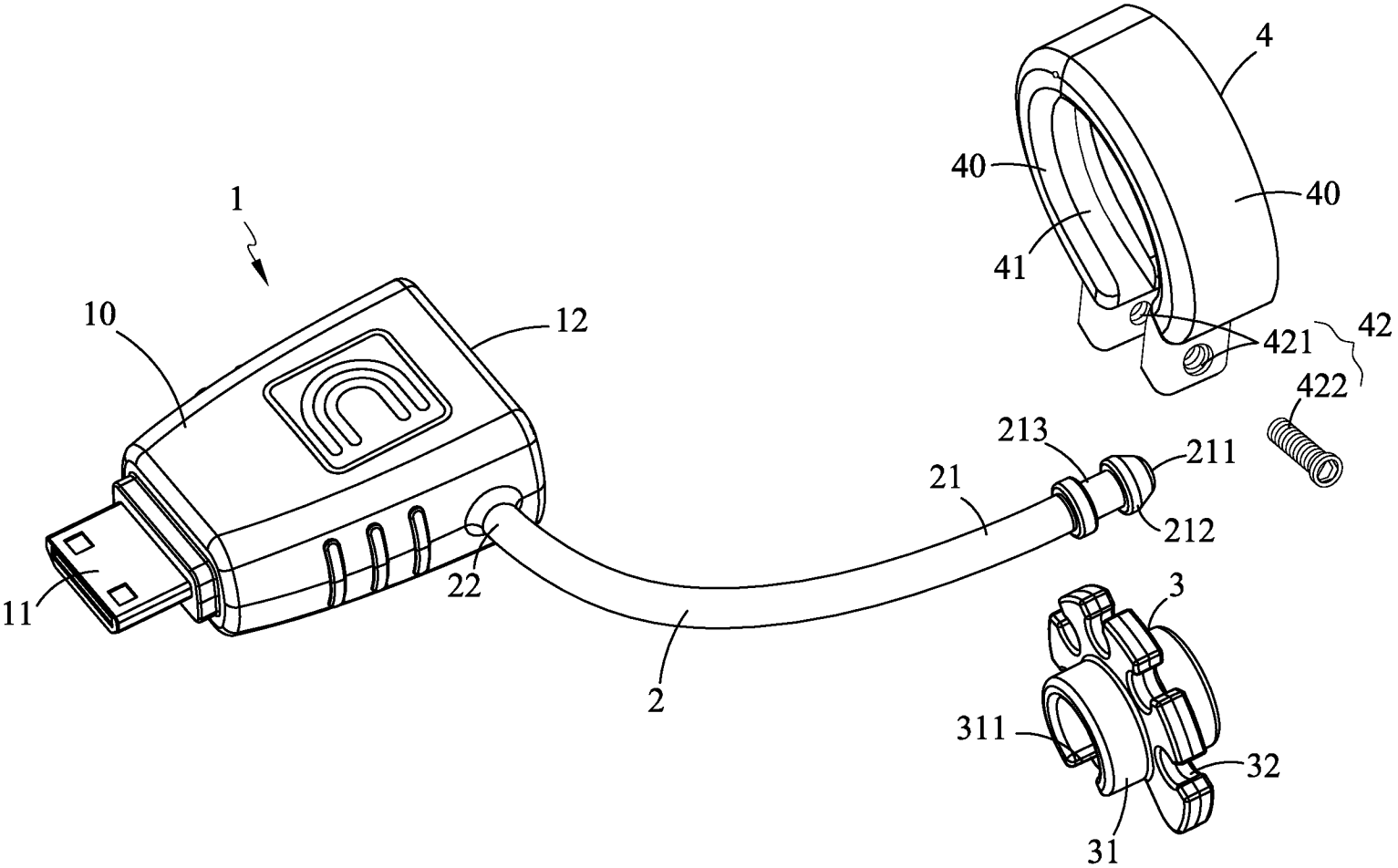
FIG. 1 is a perspective view of an anti-theft connector head structure according to an embodiment of the present invention.
Figure 2:
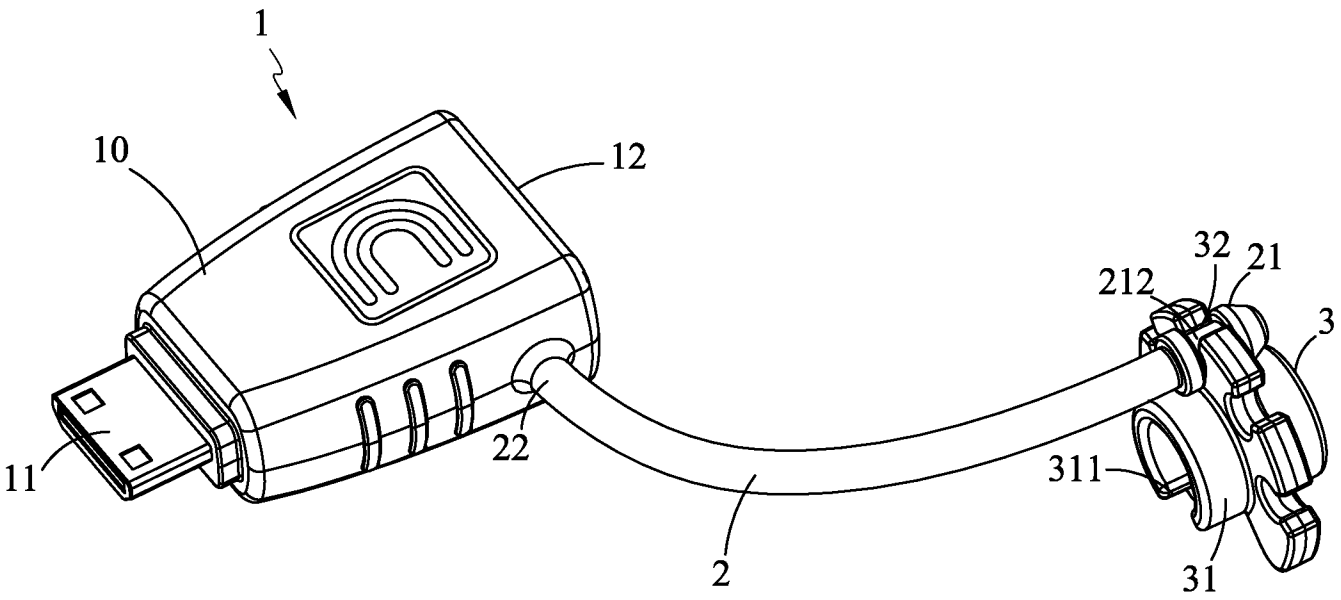
FIG. 2 is a schematic diagram of an anti-theft connector head structure assembled according to an embodiment of the present invention.

The purpose, construction, features, functions and advantages of the present invention can be appreciated and understood more thoroughly through the following detailed descriptions with reference to the attached drawings.

In the following, an embodiment is used to describe the various details of the present invention. However, it does not mean that this embodiment represents all the embodiments of the present invention. Other embodiments can be envisaged by people familiar with this field, and thus they all fall into the scope of the present invention.

Refer to FIGS. 1 to 8 respectively for a perspective view of an anti-theft connector head structure according to an embodiment of the present invention; a schematic diagram of an anti-theft connector head structure assembled according to an embodiment of the present invention; a schematic diagram of a column rod installed on an anti-theft connector head structure according to an embodiment of the present invention; a schematic diagram of an assembled anti-theft connector head structure having cables according to an embodiment of the present invention; a schematic diagram of a latch lock piece and steel wire of an anti-theft connector head structure according to an embodiment of the present invention; another schematic diagram of a latch lock piece and steel wire of an anti-theft connector head structure according to an embodiment of the present invention; and a schematic diagram of a protection sleeve of anti-theft connector head structure according to another embodiment of the present invention; and a schematic diagram of a protection sleeve of an anti-theft connector head structure based on a photograph of the real things according to a further embodiment of the present invention.

As shown in FIGS. 1-8 the present invention provides an anti-theft connector head structure, that includes at least a connector head 1, a latch lock piece 2, a fastening ring 3, and a protection sleeve 4.

On a side of a main body 10 of the connector head 1 is disposed a first connector end 11, on the other side of the main body is disposed a second connector end 12.

The latch lock piece 2 can be a flexible wire body, a tail portion of a movable end 21 on one side of the latch lock piece 2 is provided with a buckle 211, on the other side of the latch lock piece 2 is a fixed end 22, disposed on the main body 10 of the connector head 1.

In a center of the fastening ring 3 is provided with a connector seat 31, connected and fixed to a fixed point, a plurality of spacer bolt holes 32 are provided on an outer perimeter of the fastening ring 3, with the buckle 211 of the latch lock piece 2 movably fastened into the corresponding spacer bolt holes 32 respectively.

In the protection sleeve 4 is provided with a chamber 41, to receive the fastening ring 3 and the buckle 211, and on the protection sleeve 4 is disposed a locking mechanism 42 to seal up the fastening ring 3 and the buckle 211.

Figure 4:
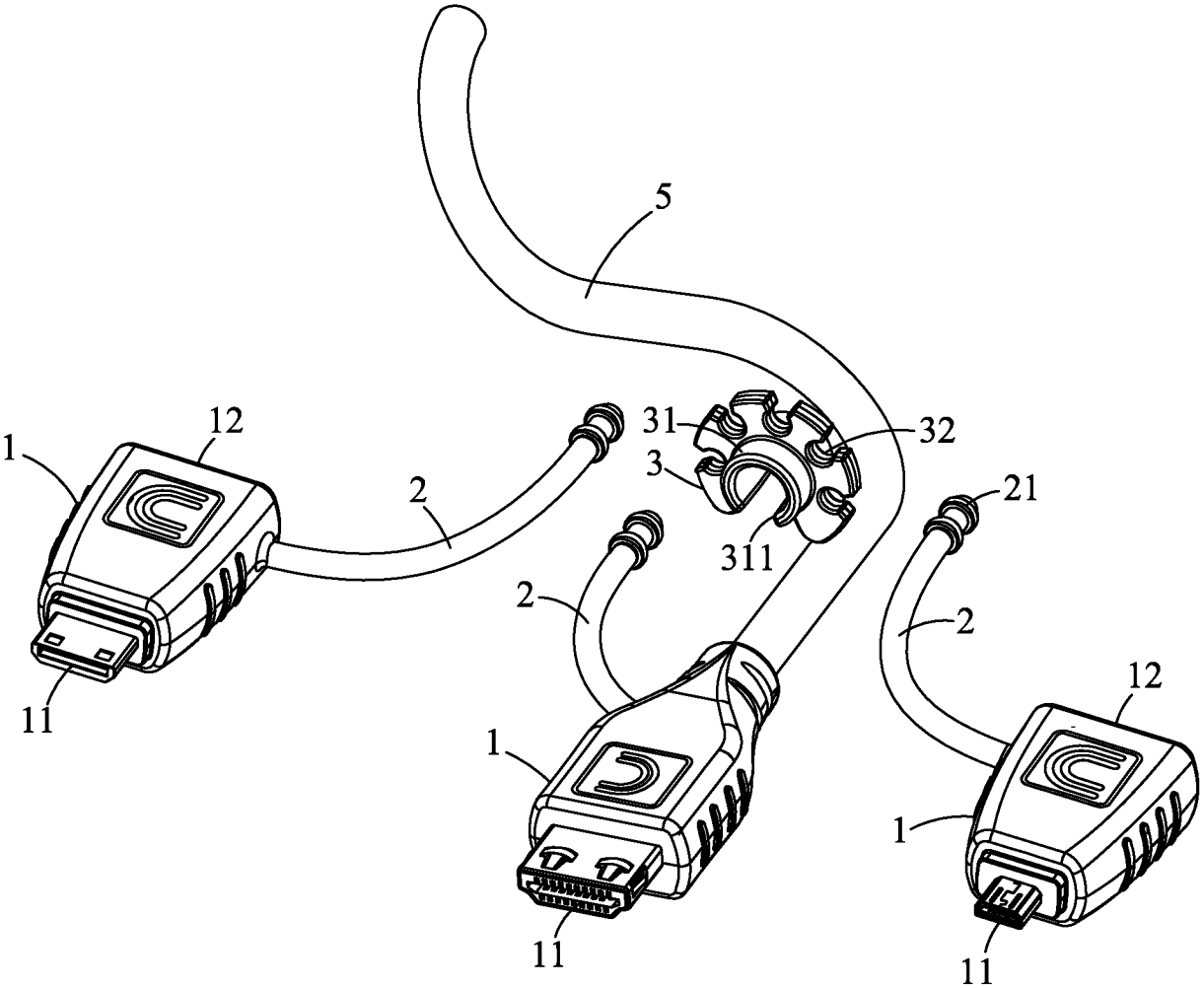
FIG. 4 is a schematic diagram of an assembled anti-theft connector head structure having cables according to an embodiment of the present invention.

As shown in FIG. 4, the latch lock piece 2 and the connection head 1 can be formed integrally into a body. The connector head 1 can be a dual plug adapter, and the connector head 1 can be plugged at two ends of the connector head 1. The connector head 1 is a cable connector, with one side of connector head plugged a cable 5, to form integrally into a body, but the present invention is not limited to this.

Figure 6:
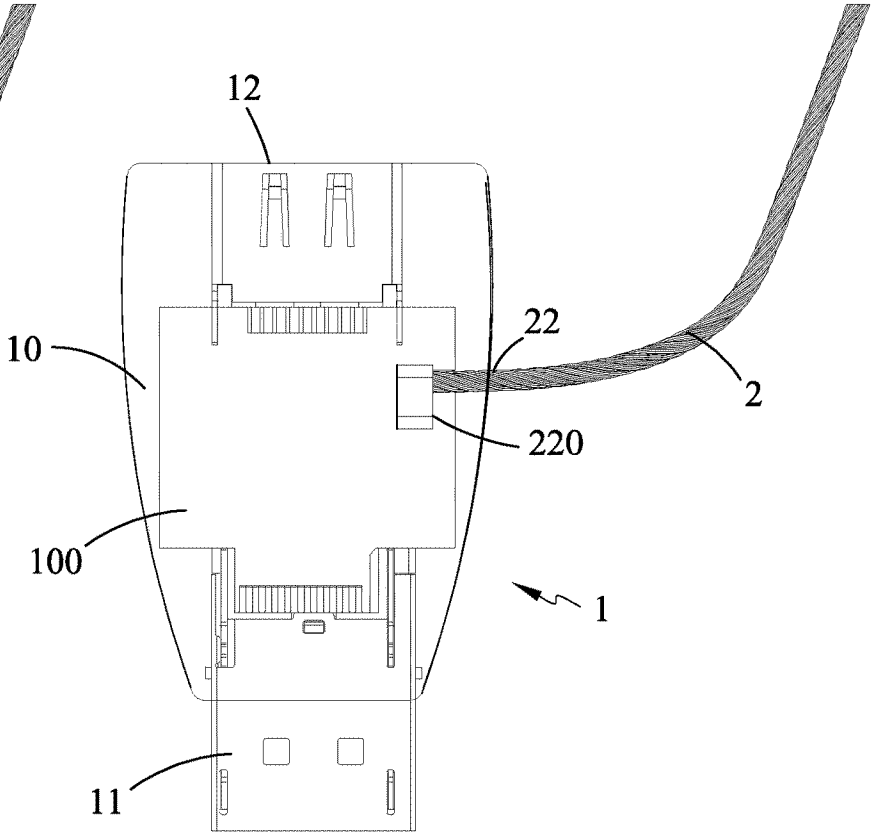
FIG. 6 is another schematic diagram of a latch lock piece and steel wire of an anti-theft connector head structure according to an embodiment of the present invention.
Figure 5:
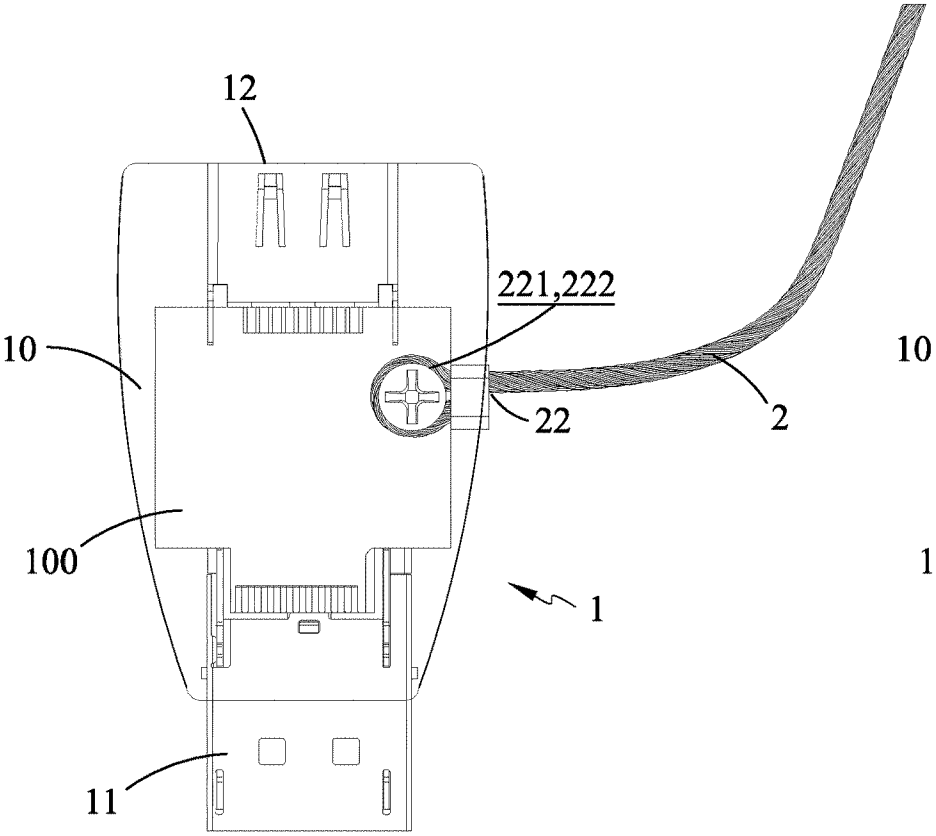
FIG. 5 is a schematic diagram of a latch lock piece and steel wire of an anti-theft connector head structure according to an embodiment of the present invention.

As shown in FIGS. 4 to 6, an electrical circuit board 100 is disposed in the main body 10 of the connector head 1, with one end of the connector head 1 disposed the first connector end 11, and with the other end of the connector head disposed the second connector end 12. The latch lock piece 2 is preferably a steel wire, having an end plate 220 welded onto the fixed end 22, or a plate having hole 221 can be locked directly onto the electrical circuit board 100 through using a screw 222. The buckle 211 of the movable end 21 is disposed a size-enlarged head portion 212, and a size-reduced bolt fastening portion 213, but the present invention is not limited to this.

On a side of the connection seat 31 of the fastening ring 3 is disposed a wire clipping opening 311 of a C shape. In operation, the wire clipping opening 311 clips and holds a column rod 6 (as shown in FIG. 3) or a cable 5 (as shown in FIG. 7) at a fixed point, but the present invention is not limited to this.

Figure 3:
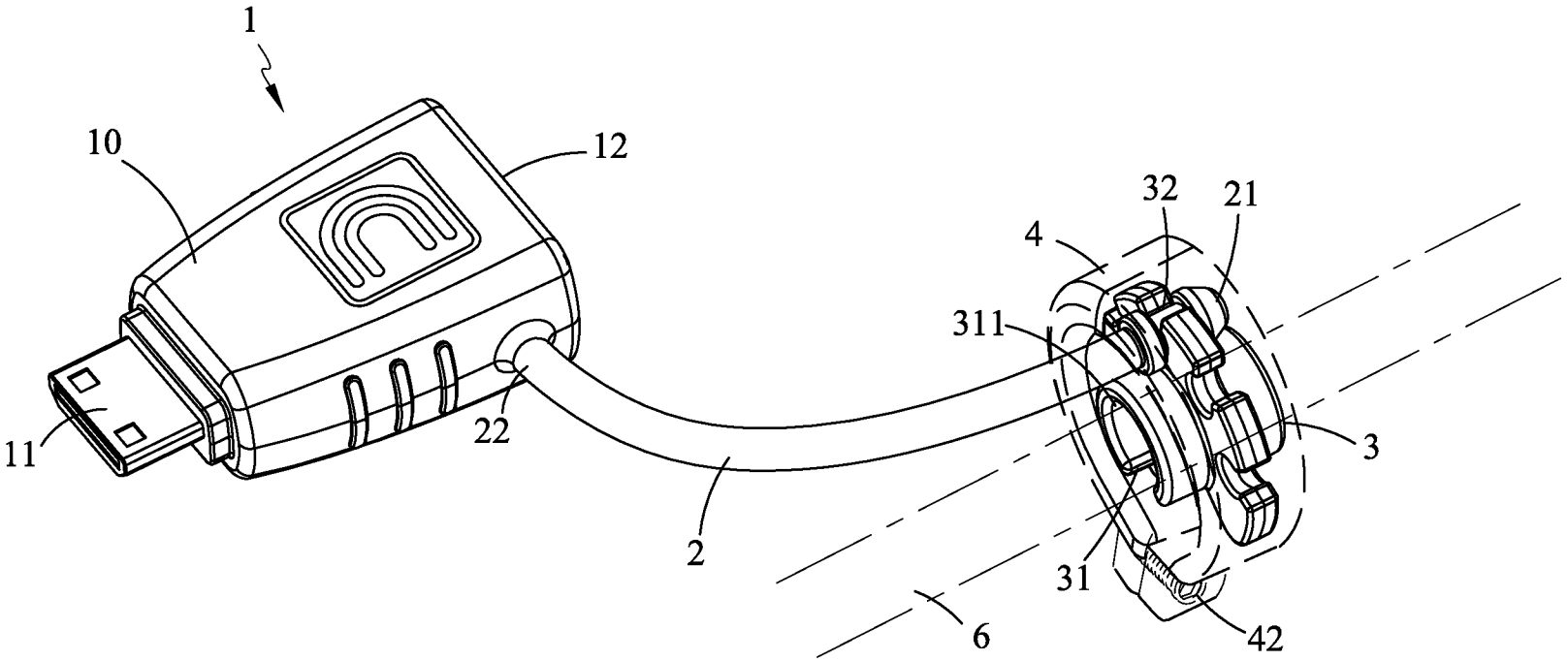
FIG. 3 is a schematic diagram of a column rod installed on an anti-theft connector head structure according to an embodiment of the present invention.

As shown in FIGS. 1,3, the protection sleeve 4 can be formed by two half protection sleeves 40 assembled together. Wherein, two sides of the respective two half protection sleeves 40 are pivoted and connected to each other, and the other two sides of the two half protection sleeves 40 are provided with two screw holes 421 and the screw 422 of the locking mechanism 42, but the present invention is not limited to this. For example, the two half protection sleeves 40 can be separated completely. The protection sleeve 4 can be formed by using the screw holes 421 and the screw 422 of the locking mechanism 42.

Figure 7:
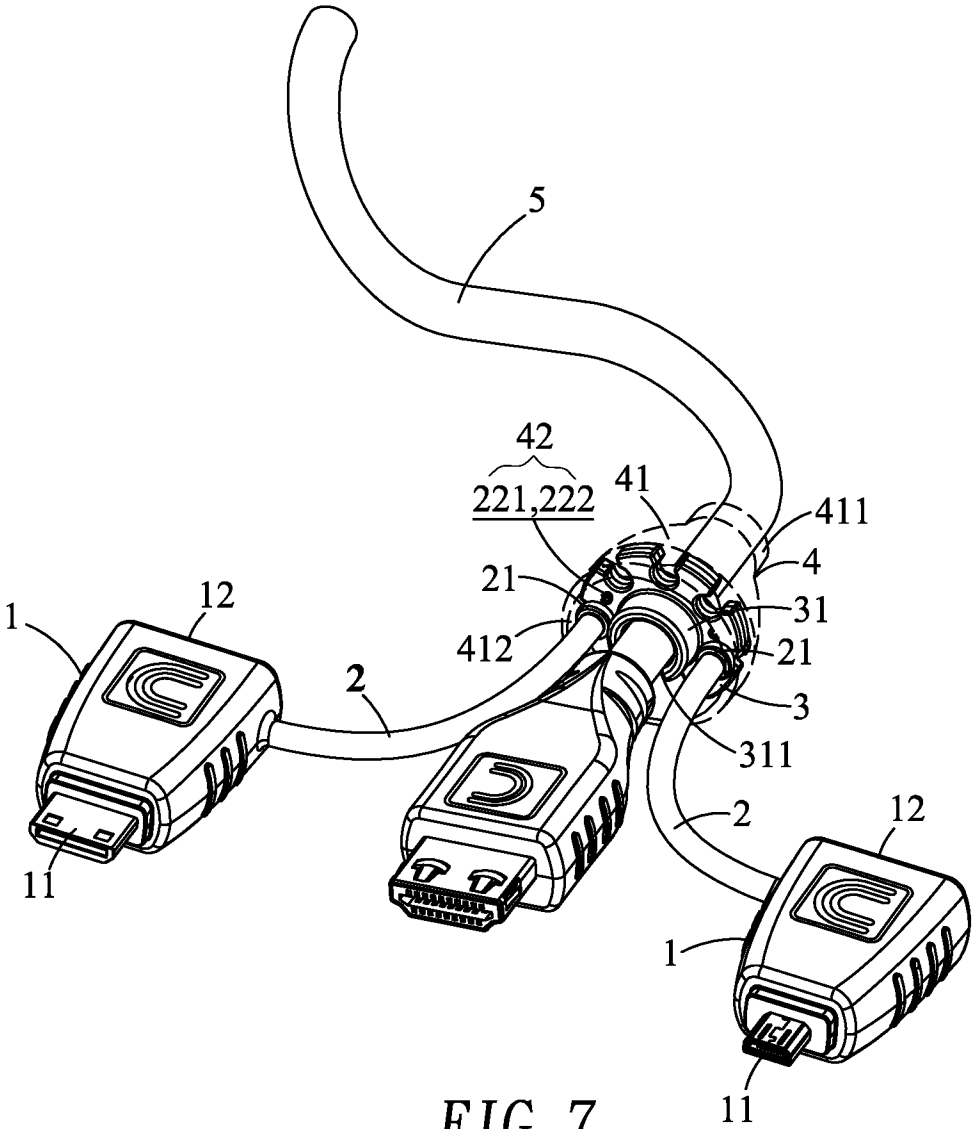
FIG. 7 is a schematic diagram of a protection sleeve of an anti-theft connector head structure according to another embodiment of the present invention.

As shown in FIG. 7, the protection sleeve 4 can be designed into a funnel shape. One side of the chamber 41 is disposed a tube sleeve opening 411 for sleeving around the cable 5; the other side of the chamber 41 is disposed an enlarged opening 412 for sleeving around the fastening ring 3. The locking mechanism 42 is formed by two screws 421 on the protection sleeve 4, and a screw 422 disposed in-between.

Subsequently, refer to FIGS. 1-8. As shown in FIGS. 1-8, in operation, firstly, using the connection seat 31 and C shape wire clipping opening 311 of the fastening ring 3, to clip onto a fixed point of the cable 5 or column rod 6, to protect the latch lock piece 2 connected to the connector head 1. Next, placing and fastening the buckle 221 disposed at a tail portion of the latch lock piece 2 into the spacer bolt holes 32 on the fastening ring 3. Then, sleeve the protection sleeve 4 around outside the fastening ring 3, to effectively seal and fix the fastening ring 3 and buckle 211 by using the locking mechanism 42, such that in this arrangement, the movement of the connector head 1 is restricted by the length of the steel wire of the latch lock piece 2. In addition, since the locking mechanism 42 is formed by two screws 421 on the protection sleeve 4, and a screw 422 (it is a special screw different from the ordinary Philips screw) disposed in-between, therefore, special tools are required to lock or unlock the anti-theft connector head structure. Due to this unique design, the respective connector head 1 around the fastening ring 3 can be protected effectively, to prevent it from being stolen easily.

Figure 8:
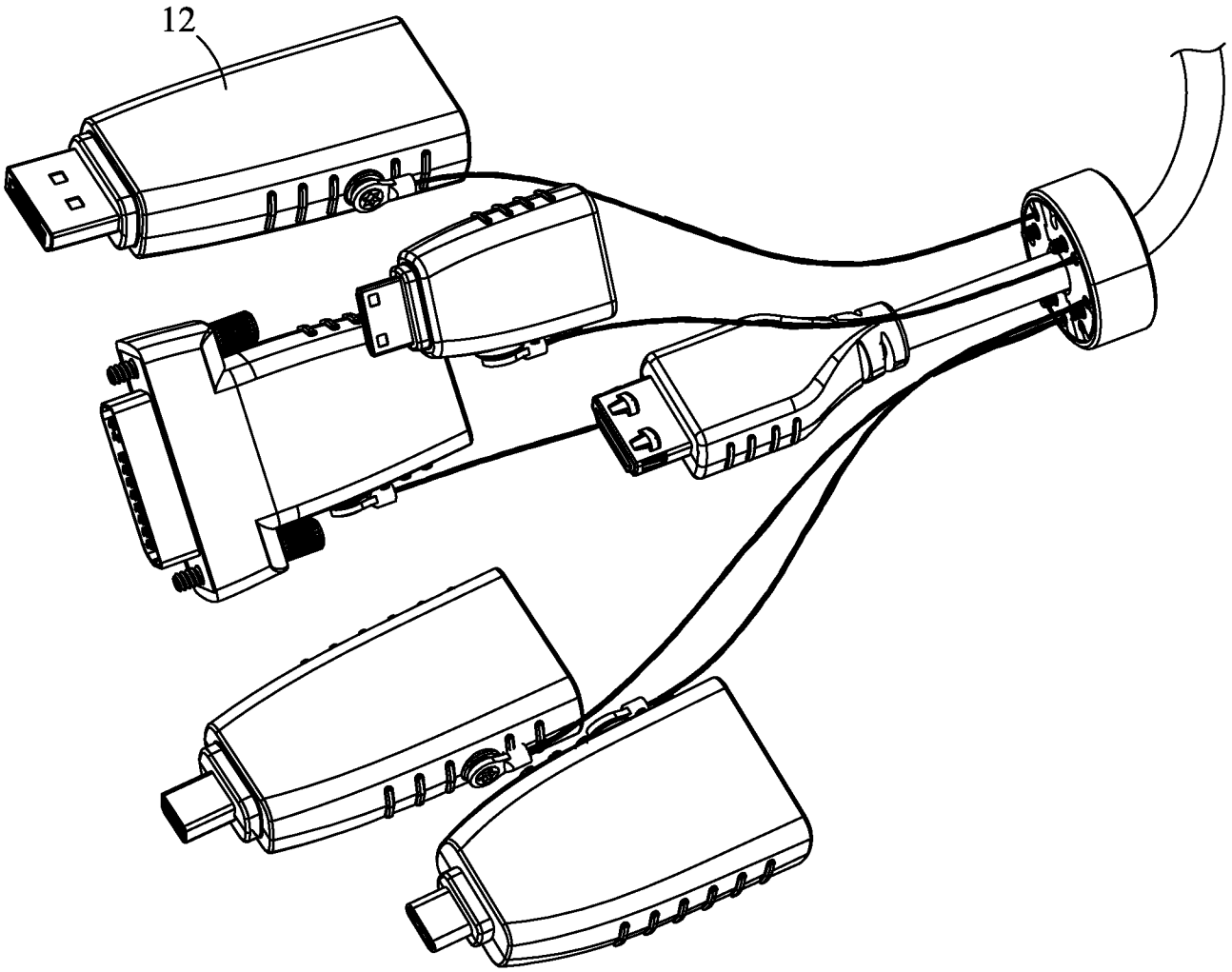
FIG. 8 is a schematic diagram of a protection sleeve of an anti-theft connector head structure based on a photograph of the real things according to a further embodiment of the present invention.

Finally, as shown in FIG. 8, the adapter on the rightest portion is a special adapter, that is quite different from the ordinary adapter used in the Prior Art. In the Prior Art, the latch lock piece (steel wire) is connected and fixed onto an electrical circuit board in an ordinary adapter. In contrast, in FIG. 8, the latch lock piece (steel wire) is connected and fixed into a screw hole on a side of the special adapter through using a screw, to offer the user convenience when attaching or detaching the latch lock piece from the special adapter.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. An anti-theft connector head structure, comprising:

at least a connector head, a latch lock piece, a fastening ring, and a protection sleeve, wherein on a side of a main body of the connector head is disposed a first connector end; and on the other side of the main body is disposed a second connector end;

the latch lock piece is a flexible wire body, a tail portion of a movable end on one side of the latch lock piece is provided with a buckle, on the other side of the latch lock piece is a fixed end, disposed on the main body of the connector head;

in a center of the fastening ring is provided with a connector seat, connected and fixed to a fix point of a cable or a rod, a plurality of spacer bolt holes are provided on an outer perimeter of the fastening ring, with the buckle of the latch lock piece being movably fastened into the corresponding spacer bolt holes respectively; and in the protection sleeve is provided with a chamber, to receive the fastening ring and the buckle, and on the protection sleeve is disposed a locking mechanism to seal up the fastening ring and the buckle; and wherein the protection sleeve is formed by two half protection sleeves facing each other, and the locking mechanism is formed by two screw holes on the two half protection sleeves respectively and a screw.

2. The anti-theft connector head structure as claimed in claim 1, wherein the latch lock piece and the connector head are formed integrally into a body.

3. The anti-theft connector head structure as claimed in claim 2, wherein the connector head is a dual plug adapter, and the connector head is plugged at two ends of the connector head.

4. The anti-theft connector head structure as claimed in claim 2, wherein the connector head is a cable connector, with one side of connector head plugged a cable, to form integrally into a body.

5. The anti-theft connector head structure as claimed in claim 2, wherein an electrical circuit board is disposed in the main body of the connector head, with one end of the connector head disposed the first connector end, and with the other end of the connector head disposed the second connector end; the latch lock piece is a steel wire, having a plate with a hole provided on a fix end of the latch lock piece, the latch lock piece is fixed and locked onto the electrical circuit board by using a screw, the buckle on the other end of the latch lock piece is disposed a size-enlarged head portion and a size-reduced bolt fastening portion.

6. The anti-theft connector head structure as claimed in claim 1, wherein two sides of the respective two half protection sleeves are pivoted connected to each other, and the other two sides of the two half protection sleeves are provided respectively with two screw holes and the screw of the locking mechanism.

7. The anti-theft connector head structure as claimed in claim 1, wherein the locking mechanism is formed by two screw holes located respectively on the two half protection sleeves, and the screw placed in between the two screw holes.

8. The anti-theft connector head structure as claimed in claim 7, wherein the protection sleeve is of a funnel shape, on one side of the chamber of the protection sleeve is disposed a tube sleeve opening to sleeve around the cable, on the other side of a chamber of the protection sleeve is disposed an enlarged opening to circle around the fastening ring.

9. The anti-theft connector head structure as claimed in claim 8, wherein on a side of the connection seat is disposed a wire clipping opening of a C shape.

* * * * *